US008678083B2

(12) United States Patent
Xu

(10) Patent No.: US 8,678,083 B2
(45) Date of Patent: Mar. 25, 2014

(54) EXPANDABLE LINER HANGER WITH HELICALLY SHAPED SLIPS

(75) Inventor: Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 373 days.

(21) Appl. No.: 13/089,006

(22) Filed: Apr. 18, 2011

(65) Prior Publication Data

US 2012/0261116 A1 Oct. 18, 2012

(51) Int. Cl.
*E21B 23/02* (2006.01)

(52) U.S. Cl.
USPC ..... 166/208; 166/206

(58) Field of Classification Search
USPC ..... 166/206, 208
See application file for complete search history.

(56) References Cited

U.S. PATENT DOCUMENTS

| | | | | |
|---|---|---|---|---|
| 2,174,076 | A * | 9/1939 | Bowen | 294/86.17 |
| 2,670,797 | A * | 3/1954 | Armentrout | 166/136 |
| 3,714,984 | A * | 2/1973 | Read | 166/134 |
| 3,779,314 | A * | 12/1973 | Read | 166/216 |
| 3,851,707 | A * | 12/1974 | Jett | 166/212 |
| 4,488,595 | A * | 12/1984 | Akkerman | 166/206 |
| 4,498,534 | A * | 2/1985 | Lindsey, Jr. | 166/208 |
| 4,583,590 | A * | 4/1986 | Greenlee et al. | 166/216 |
| 6,752,216 | B2 * | 6/2004 | Coon | 166/387 |
| 6,899,181 | B2 | 5/2005 | Simpson et al. | |
| 6,968,896 | B2 * | 11/2005 | Coon | 166/117.6 |
| 7,055,597 | B2 | 6/2006 | Lauritzen | |
| 7,096,938 | B2 | 8/2006 | Carmody et al. | |
| 7,306,034 | B2 * | 12/2007 | Garcia | 166/206 |
| 7,360,592 | B2 * | 4/2008 | McMahan | 166/207 |
| 7,367,390 | B2 | 5/2008 | Carmody et al. | |
| 7,607,476 | B2 * | 10/2009 | Tom et al. | 166/207 |
| 8,443,881 | B2 * | 5/2013 | Thomson et al. | 166/207 |
| 2003/0037931 | A1 * | 2/2003 | Coon | 166/387 |
| 2007/0039161 | A1 * | 2/2007 | Garcia | 29/507 |
| 2010/0089591 | A1 | 4/2010 | Thompson et al. | |
| 2012/0012305 | A1 * | 1/2012 | Yokley | 166/208 |
| 2012/0261116 | A1 * | 10/2012 | Xu | 166/208 |

* cited by examiner

*Primary Examiner* — Jennifer H Gay
(74) *Attorney, Agent, or Firm* — Steve Rosenblatt

(57) ABSTRACT

A liner hanger uses a spirally shaped slip member that makes at least one revolution about the mandrel being expanded. The slip member is disposed in a groove with tapered end walls that approach each other during radial mandrel expansion due to shrinkage of said mandrel in the longitudinal direction. The shrinkage binds the slip to the mandrel as the slip member approaches the surrounding tubular. The tapered side walls of the groove moving together cam out the slip member into enhanced contact with the surrounding tubular to support the liner or other string below the hanger. The slip member and groove have preferably the same pitch to allow easy mounting with an applied rotational force.

30 Claims, 7 Drawing Sheets

EXPANDABLE LINER HANGER WITH HELICALLY SHAPED SLIPS

FIELD OF THE INVENTION

The field of the invention is expandable liner hangers and more particularly a spiral slip design disposed in a groove with tapered side walls to uniformly move the spiral slip member out as expansion reduces the groove width to enhance a grip on a surrounding tubular.

BACKGROUND OF THE INVENTION

Spiral patterns have been used in downhole tools as passages for cement in the context of expansion such as in hangers for liners that are set by expansion. Examples of such spiral paths for flow of displaced fluids during cementing are U.S. Pat. Nos. 6,899,181, see FIG. 9, and 7,055,597, see FIG. 7.

Another design uses grooves to reduce stress during expansion and as a location for metal displacement under inserts as the inserts engage the surrounding tubular. The stress relieving zones 885 are taught to be spiral in one alternative for the purpose of reducing expansion stress as discussed in paragraph 82 of U.S. Publication 2010/0089591.

The reality of longitudinal shrinkage during expansion of tubulars has been deployed in liner hangers to drive out slip rings 36 and 38 that are described as a cylindrical shape with a longitudinal split, a cylinder that separates into segments on expansion or a series of segments retained with a band spring in column 3 lines 52-58 of U.S. Pat. No. 7,096,938. The same description is found in the continuation U.S. Pat. No. 7,367,390.

What has yet to be developed and addressed by the present invention is a slip design that takes advantage of the longitudinal shrinkage during expansion of the hanger and configures the slip design to evenly load the surrounding tubular despite any shape irregularities it may have over an extended length of the hanger. The open nature of the slip design allows for circumferential coverage over a longer length than a longitudinally split cylinder. Beyond that a spiral design can be threaded on during assembly and provides negligible resistance to expansion. The retaining groove not only radially extends a spiral shape but also winds up gripping the slip shape more tightly as the mandrel is radially expanded and the differential longitudinal growth from mandrel expansion cocks the slip member slightly in its retaining groove to prevent shifting until the surrounding tubular wall is engaged. These and other advantages of the present invention will be more apparent to those skilled in the art from a review of the detailed description of the preferred embodiment and the associated figures while recognizing that the full scope of the invention is to be determined by the appended claims.

SUMMARY OF THE INVENTION

A liner hanger uses a spirally shaped slip member that makes at least one revolution about the mandrel being expanded. The slip member is disposed in a groove with tapered end walls that approach each other during radial mandrel expansion due to shrinkage of said mandrel in the longitudinal direction. The shrinkage binds the slip to the mandrel as the slip member approaches the surrounding tubular. The tapered side walls of the groove moving together cam out the slip member into enhanced contact with the surrounding tubular to support the liner or other string below the hanger. The slip member and groove have preferably the same pitch to allow easy mounting with an applied rotational force.

DETAILED DESCRIPTION OF THE PREFERRED EMBODIMENT

Figure 1:
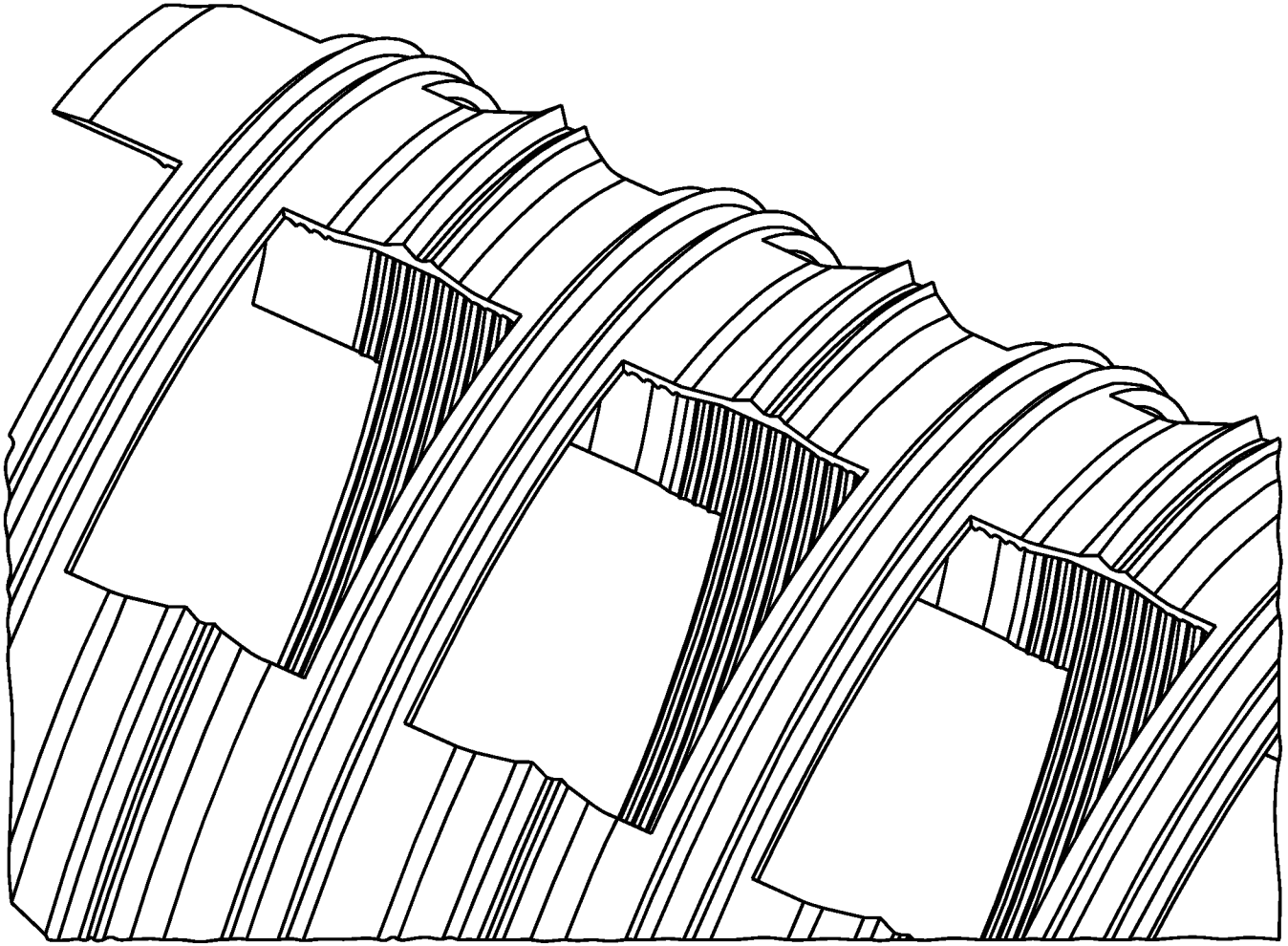
(PRIOR ART) FIG. 1
FIG. 1 is a perspective view of a cylindrically shaped slip ring used in existing expandable liner hangers.
Figure 2:
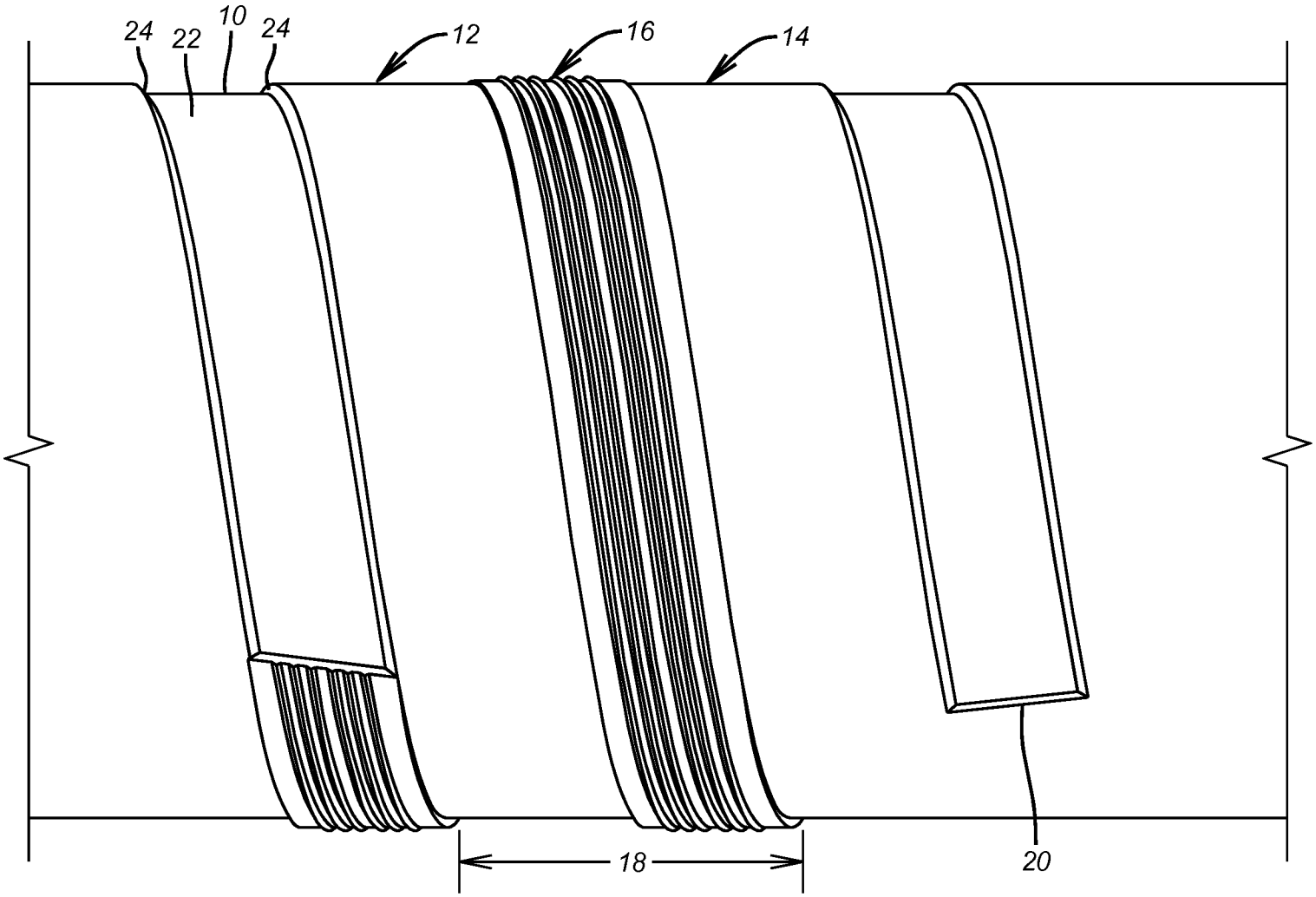
FIG. 2 shows the spiral slip member on a mandrel.

Referring to FIG. 2 the groove 10 is spirally cut in the mandrel 12 outer surface 14. While the groove 10 and the slip member 16 that fits at least in part in groove 10 are shown with a constant width, the width can vary as to the groove 10 and the slip member 16 along their respective lengths and preferably but not necessarily in tandem. The pitch represented by arrow 18 can be constant or it can vary. The length of the groove 10 should be sufficient for greater than 360 degree revolution of the slip member 16 and in the preferred embodiment almost three revolutions are illustrated. The slip member 16 can extend for the running length of the groove 10 or it can be shorter such as illustrated where the end of the slip member 16 is not shown near the groove end 20.

Figure 3:
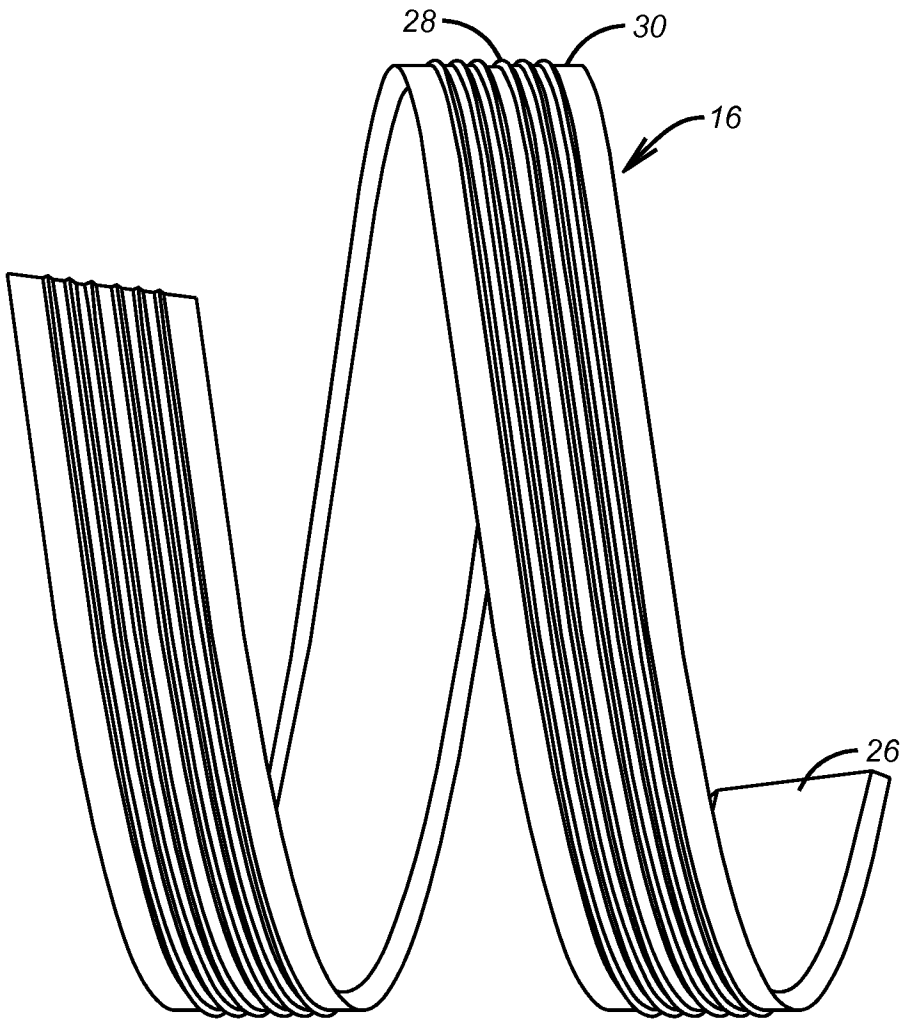
FIG. 3 shows the helical slip by itself without the underlying mandrel.

The groove 10 is defined by a recessed radial surface 22 flanked by outwardly tapering side walls 24. While all the surfaces are illustrated as flat, other configurations are envisioned. The side walls 24 or bottom 22 can be arcuate. The bottom surface can be undulating and match a similar shape on the face 26 of the slip member 16 shown in FIG. 3. The outer surface 27 of the slip member 16 has at least one and preferably a plurality of raised rings 28 that can have equal or unequal height and/or spacing with the intention that as a result of expansion that there is at least a frictional contact with the surrounding tubular (not shown) for support and preferably a penetration of the wall of the surrounding tubular for an enhanced supporting grip into the surrounding tubular so that the liner or other tubular string can be securely supported. While rings with pointed or sharp leading ends for penetration into the surrounding well bore are preferred, other designs that penetrate the surrounding tubular or frictionally engage it are also contemplated. Tungsten carbide inserts or a matrix material 21 such as used in certain drill bits can be placed on the outer surface 30 of the slip member 16.

Figure 4:
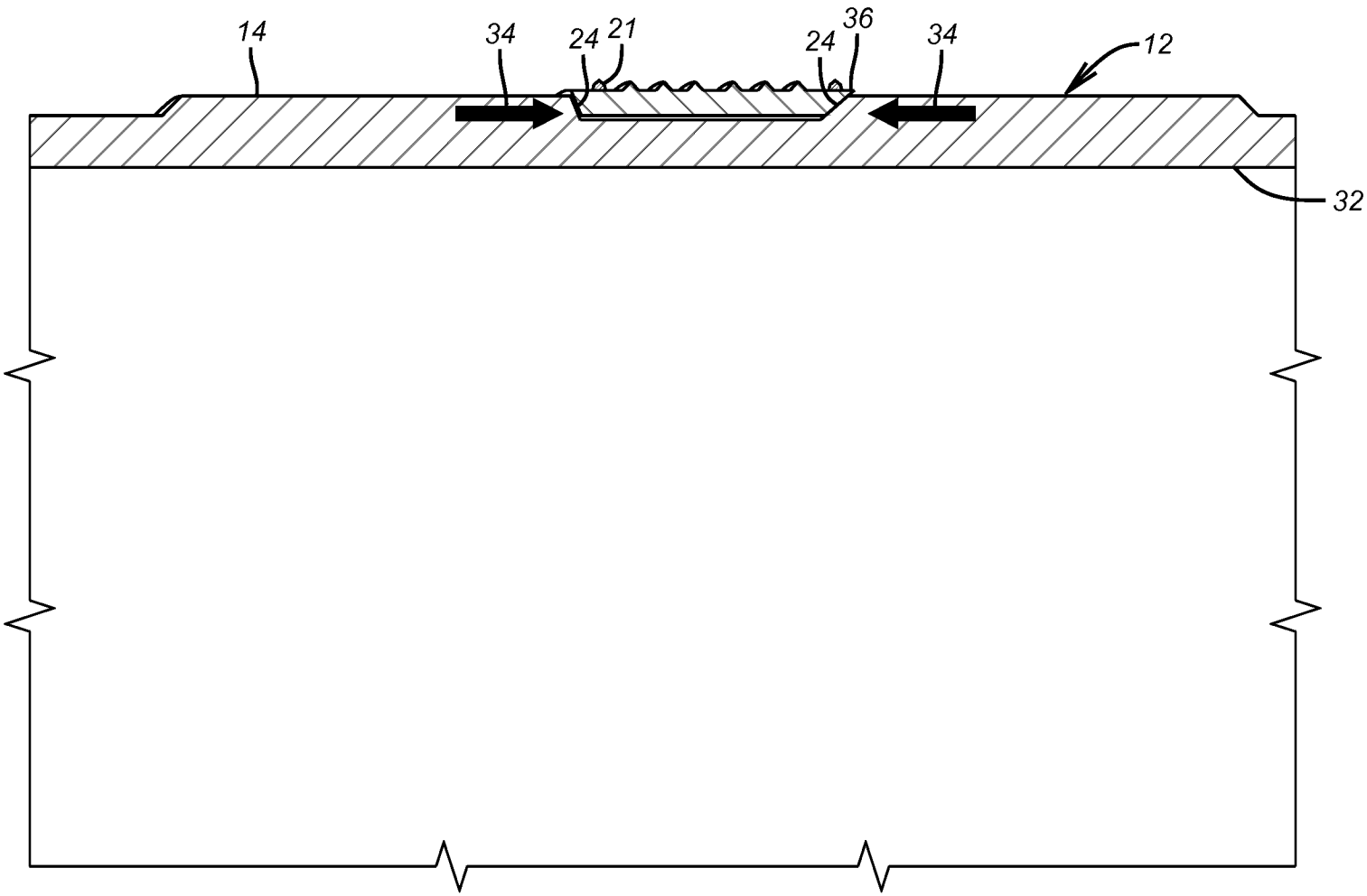
FIG. 4 is a section view through the mandrel and slip showing the narrowing of the mandrel groove during expansion.

FIG. 4 illustrates what occurs as the mandrel 12 is expanded while either in tension or while the mandrel is placed in compression. As the diameter increases when an expansion cone advances through the bore 32, the length experiences shrinkage as indicated by arrows 34. As a result, opposed sidewalls 24 get closer together to cam out the slip member 16 even as the diameter of the slip member 16 grows with the radially expanding mandrel 12. It should be noted that the sidewalls 24 move toward each other in an initial period before the raised rings 28 make contact with the surrounding tubular. In a subsequent phase the sidewalls 24 continue to come together as the rings 28 encounter and/or penetrate the surrounding tubular wall. It should be noted that the slopes of the sidewalls need not be at the same angle. In some situations it may be preferable to have the slip member 16 to have one end get cammed out before the opposing end of the slip member 16 rather than in a parallel orientation to the outer wall 14. Since the string being supported is typically below the hanger it may be desirable to have the downhole edge 36 forced out first so that it can get the stronger bite for better support of the hanging load below from the suspended string. Alternatively, within manageable tolerances, the pitch of the slip member 16 can differ from the pitch of the associated groove 10 as long as the slip member can be sufficiently recessed in the groove 10 for run in without being biased outwardly during run in so that it would get pried loose or snag on some internal projection or radial surface in the surrounding tubular for run in.

Figure 5:
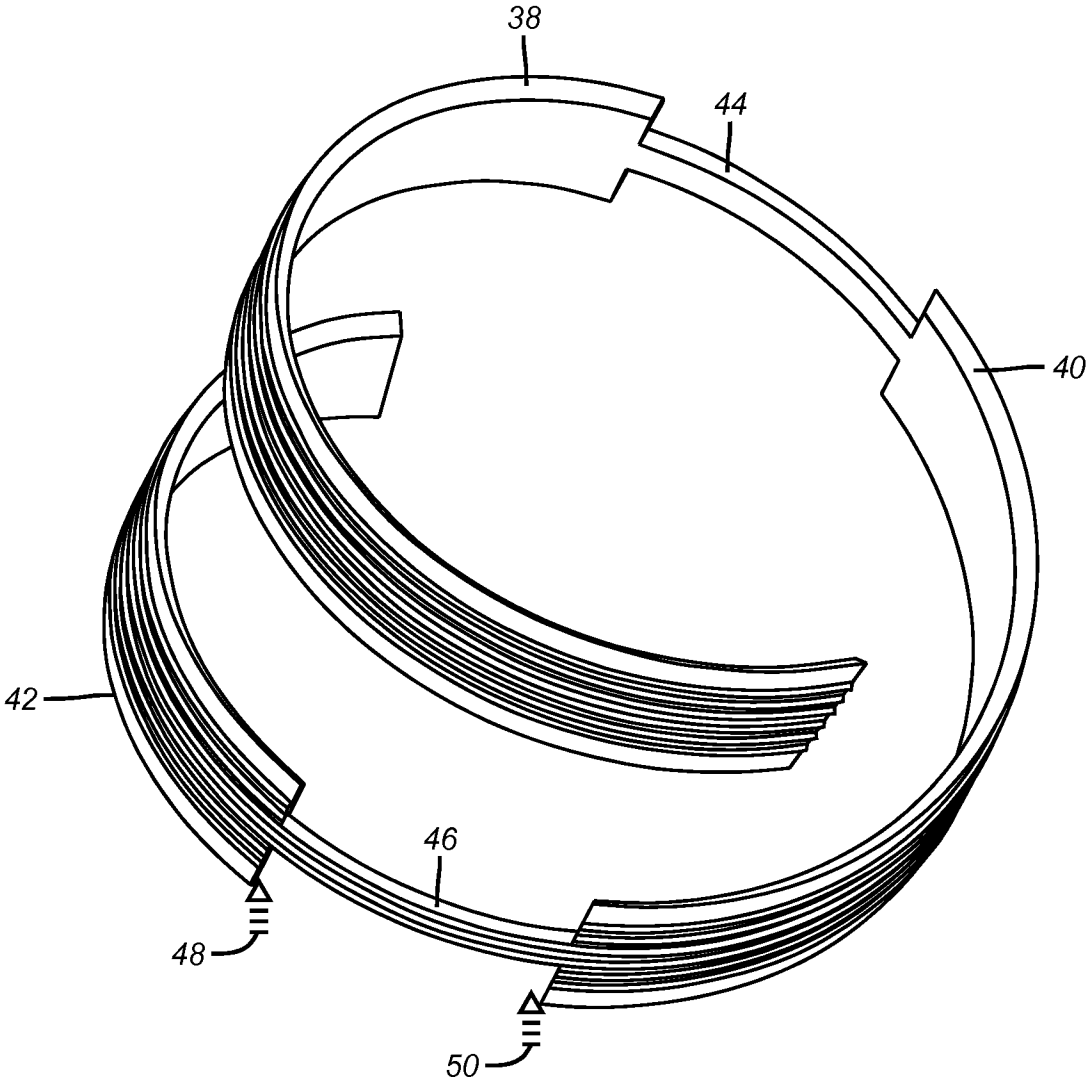
FIG. 5 shows a segmented slip member in a perspective view.

FIG. 5 illustrates slip segments 38, 40 and 42 separated by thinner spacers 44 and 46 as part of a slip member 16 assembly. The assembly can be longer and a portion is illustrated to make the point that as long as there is 360 degree load distribution that the contact need not occur in a single wrap around the surface 14 but the support can be in different wraps along the groove 10. The goal is to have in any vertical axis at least one of the slip segments disposed even though above and/or below that segment on that axis there is a connector. The connectors 44 or 46 can be softer than the segments 38, 40 and 42 since in the preferred embodiment there is no need for these segments to penetrate a surrounding tubular. The presence of the segments makes the resistance to expansion by the assembly of segments shown in FIG. 5 practically insignificant. The connectors such as 44 or 46 should be flexible and despite the expansion remain intact to space out the segments 38, 40 and 42 and any additional segments that might be used. As another option the connectors 44 or 46 can be stiffer to the point of having a grip enhancing feature on the external face for additional load carrying capability in addition to the segments 38, 40 and 42. The grip enhancing feature can be a continuation from what appears on segments 38, 40 and 42 or it can be a different arrangement.

Optionally the connectors can also be designed to release on one or opposed ends, the segments to which they were initially attached. If this is designed into the assembly it is preferred that the connectors 44 or 46 release at a time when the segments are already in contact with the surrounding tubular so that the release will not facilitate sliding of the released segments in the groove 10. To prevent such sliding, schematically illustrated travel stops 48 and 50 can be placed in the adjacent groove 10 to prevent such sliding motion.

The spiral windings can be left hand or right hand oriented. Installation of the spiral slip member can be by a simple threading action. The assembly has enough flexibility to work its way onto the mandrel groove 10 with an applied rotational movement. The entrance at the leading end of the groove 10 can be sloped to aid the slip member 16 in getting started into the groove 10 under the force of a rotational movement applied to the slip member 16 to get it into position for running to a subterranean location.

Those skilled in the art will appreciate that the spiral orientation of the slip member makes it simple to assembly to the mandrel and allows slip contact with the surrounding tubular over a longer length of the surrounding tubular than a ring structure. The slip material usage is minimized relative to known designs by using a spiraling elongated element instead of a more complex ring structure that employs an array of open areas to minimize resistance to expansion that also has the result of increasing part cost. Simple vertically split cylindrical shapes cannot by definition cover for a full 360 degrees of supporting the tubular string load. Rather, the split by design opens in the expansion mode leaving more load on the balance of the circumference of the now open ring structure thus limiting the capacity of the slip system.

Figure 6:
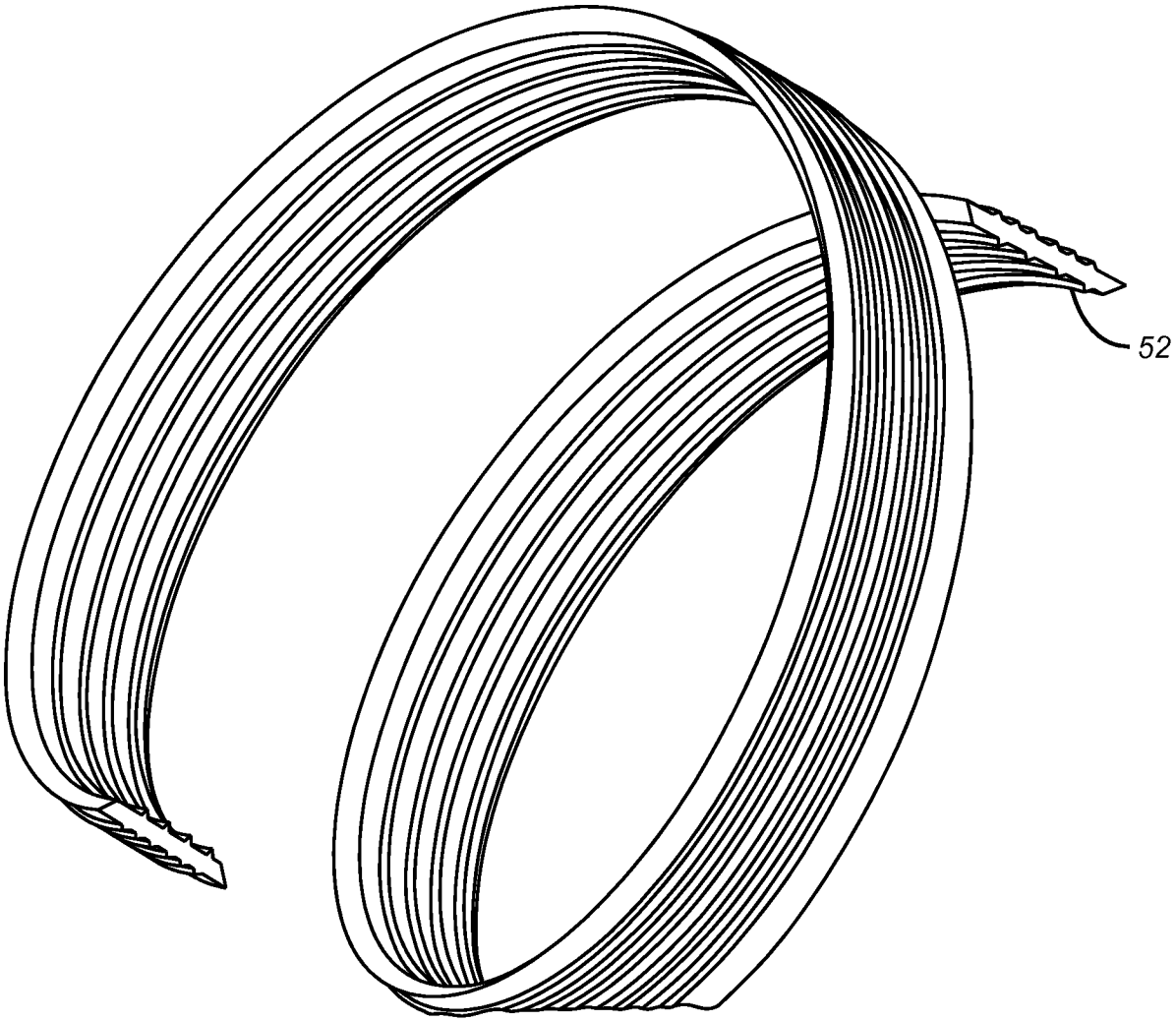
FIG. 6 is an alternative embodiment of a slip member that uses wickers to engage the mandrel outer wall making the use of a groove optional.
Figure 7:
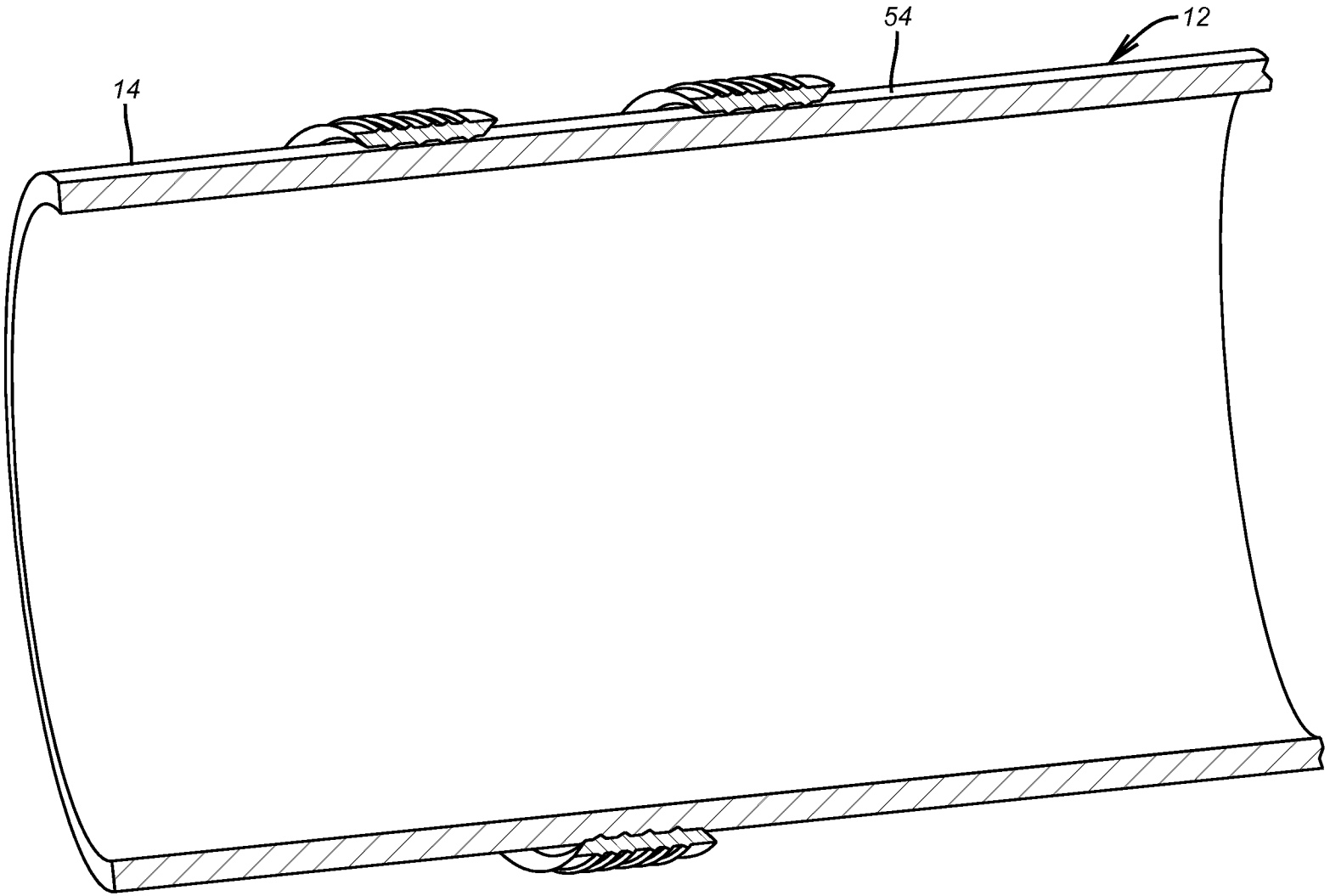
FIG. 7 is a section view of the slip member of FIG. 6 taken through the mandrel wall.

FIGS. 6 and 7 illustrate an alternative embodiment that makes the use of a groove optional. Comparing FIGS. 3 and 6 it can be seen that in FIG. 6 there is a grip enhancement feature 52 on the inside surface of the slip member 16 and a similar grip enhancing treatment 54 on the mandrel 12 on its outer surface 14. Optionally, a groove such as 10 can be provided to also get the camming action in a radial direction. When used with a groove the grip enhancement feature 52 becomes less significant as the camming feature will move 52 away from the groove bottom such as 22 upon expansion. Without a groove, the inner grip enhancement feature 52 helps to keep the slip member 16 in position during run in and minimize relative rotation as the hanger is advanced to the location of deployment. It should be noted that with the use of a spiral shape and no groove the ultimate orientation of the slip member 16 with respect to the mandrel 12 is not significant as long as more than 360 degrees of support is provided. The feature 52 can be identical to the exterior feature 28 or different. Preferably the outer surface 14 of the mandrel 12 should be textured to enhance grip and prevent relative rotation between the mandrel 12 and the slip member 16 as illustrated at 54 in FIG. 7. Optionally, the grip enhancing feature can be on the mandrel outer surface exclusively or on the slip member exclusively or both. When on both the grip enhancing features can be identical or different and include the variations discussed above for item 28 or other configurations.

The above description is illustrative of the preferred embodiment and many modifications may be made by those skilled in the art without departing from the invention whose scope is to be determined from the literal and equivalent scope of the claims below.

I claim:

1. A hanger assembly for subterranean use to engage a surrounding tubular, comprising;

a mandrel having a passage therethrough that is defined by a wall having an outer surface;

a slip member extending circumferentially around said mandrel in excess of 360 degrees and in initial circumferential contact with said wall in an initial radial dimension of said mandrel, said mandrel is radially expanded to an enlarged radial dimension, said radial expansion of said mandrel moves said slip member into engagement with the surrounding tubular by elongation of said slip member while retaining slip member engagement with said wall.

2. The assembly of claim 1, wherein:

said slip member comprises a grip enhancing feature facing said mandrel.

3. The assembly of claim 1, wherein:

said slip member comprises spaced connected segments using at least one connection, said slip member so disposed on said mandrel such that along any longitudinal axis on said wall a segment overlies a connection.

4. The assembly of claim 3, wherein:

said connection further comprises an elongated segment that is narrower than a width of said slip member that provides flexibility to said slip member to facilitate mounting said slip member to said mandrel.

5. The assembly of claim 4, wherein:
said connection remains operable after said mandrel is expanded.

6. The assembly of claim 3, wherein:
said connection further comprises a grip enhancing feature on an outer surface thereof.

7. A hanger assembly for subterranean use to engage a surrounding tubular, comprising;
a mandrel having a passage therethrough that is defined by a wall having an outer surface;
a slip member extending circumferentially around said mandrel in excess of 360 degrees and in initial circumferential contact with said wall in an initial radial dimension of said mandrel, said mandrel having an expanded radial dimension that moves said slip member into engagement with the surrounding tubular by elongation of said slip member while retaining slip member engagement with said wall;
at least one groove disposed in said outer surface and extending around said wall;
said slip member disposed in said groove and extending radially at least in part from said groove.

8. The assembly of claim 7, wherein:
said groove comprises a spiral.

9. The assembly of claim 8, wherein:
said slip member is uniformly configured along the length of said slip member.

10. The assembly of claim 9, wherein:
said groove is uniformly configured along the length of said slip member.

11. The assembly of claim 8, wherein:
said groove comprises a bottom surface and opposed mirror image end surfaces.

12. The assembly of claim 11, wherein:
said end surface incline away from each other moving away form said bottom surface.

13. The assembly of claim 11, wherein:
said bottom surface conforms to an opposed surface on said slip member.

14. The assembly of claim 8, wherein:
said groove has opposed sloping flat walls that slope at different angles with respect to a bottom surface of said groove.

15. The assembly of claim 7, wherein:
said slip member comprises spaced connected segments using at least one connection, said slip member so disposed on said mandrel such that along any longitudinal axis on said wall a segment overlies a connection.

16. The assembly of claim 15, wherein:
said connection further comprises an elongated segment that is narrower than a width of said slip member that provides flexibility to said slip member to facilitate mounting said slip member to said mandrel.

17. The assembly of claim 16, wherein:
said connection remains operable after said mandrel is expanded.

18. The assembly of claim 15, wherein:
said connection further comprises a grip enhancing feature on an outer surface thereof.

19. The assembly of claim 7, wherein:
said slip member further comprises a grip enhancing feature on an outer surface thereof.

20. The assembly of claim 19, wherein:
said grip enhancing feature comprises at least one of pointed rings of equal or unequal height and hardened inserts randomly or uniformly applied.

21. A hanger assembly for subterranean use, comprising;
a mandrel having a passage therethrough that is defined by a wall having an outer surface;
a slip member extending circumferentially around said mandrel in excess of 360 degrees;
at least one groove disposed in said outer surface and extending around said wall;
said slip member disposed in said groove and extending radially at least in part from said groove;
said groove comprises a spiral;
said slip member is non-uniformly configured along the length of said slip member.

22. A hanger assembly for subterranean use, comprising;
a mandrel having a passage therethrough that is defined by a wall having an outer surface;
a slip member extending circumferentially around said mandrel in excess of 360 degrees;
at least one groove disposed in said outer surface and extending around said wall;
said slip member disposed in said groove and extending radially at least in part from said groove;
said groove comprises a spiral;
said slip member is uniformly configured along the length of said slip member;
said groove is asymmetrically configured along the length of said groove.

23. A hanger assembly for subterranean use, comprising;
a mandrel having a passage therethrough that is defined by a wall having an outer surface;
a slip member extending circumferentially around said mandrel in excess of 360 degrees;
at least one groove disposed in said outer surface and extending around said wall;
said slip member disposed in said groove and extending radially at least in part from said groove;
said slip member comprises spaced connected segments using at least one connection, said slip member so disposed on said mandrel such that along any longitudinal axis on said wall a segment overlies a connection;
said connection further comprises an elongated segment that is narrower than a width of said slip member that provides flexibility to said slip member to facilitate mounting said slip member to said mandrel;
said connection remains operable after said mandrel is expanded;
said connection breaks as a result of mandrel expansion.

24. The assembly of claim 23, wherein:
said segments are restrained from translation within said groove beyond a predetermined distance by at least one travel stop.

25. A hanger assembly for subterranean use, comprising;
a mandrel having a passage therethrough that is defined by a wall having an outer surface;
a slip member extending circumferentially around said mandrel in excess of 360 degrees;
at least one groove disposed in said outer surface and extending around said wall;
said slip member disposed in said groove and extending radially at least in part from said groove;
said groove defined by opposed elongated edges that move together as a result of mandrel expansion to cam said slip member out of said groove.

26. The assembly of claim 25, wherein:
said edges are configured to cam said slip member parallel or at an angle to said wall.

27. The assembly of claim 26, wherein:

said spiral is wound left or right handedly and said pitch of said spiral is uniform or variable.

28. A hanger assembly for subterranean use, comprising;

a mandrel having a passage therethrough that is defined by a wall having an outer surface;

a slip member extending circumferentially around said mandrel in excess of 360 degrees;

said mandrel comprises a grip enhancing feature facing said slip member.

29. A hanger assembly for subterranean use, comprising;

a mandrel having a passage therethrough that is defined by a wall having an outer surface;

a slip member extending circumferentially around said mandrel in excess of 360 degrees;

said mandrel and said slip member comprise grip enhancing features that face each other.

30. A hanger assembly for subterranean use, comprising;

a mandrel having a passage therethrough that is defined by a wall having an outer surface;

a slip member extending circumferentially around said mandrel in excess of 360 degrees;

said slip member comprises spaced connected segments using at least one connection, said slip member so disposed on said mandrel such that along any longitudinal axis on said wall a segment overlies a connection;

said connection further comprises an elongated segment that is narrower than a width of said slip member that provides flexibility to said slip member to facilitate mounting said slip member to said mandrel;

said connection breaks as a result of mandrel expansion.

* * * * *